US005517715A

United States Patent [19]

Monson

[11] Patent Number: 5,517,715

[45] Date of Patent: May 21, 1996

[54] CLEANING HEAD

[76] Inventor: Clifford L. Monson, 6115 130th Ave. NE., Kirkland, Wash. 98033

[21] Appl. No.: 297,242

[22] Filed: Aug. 25, 1994

[51] Int. Cl.[6] ..... A47L 11/34

[52] U.S. Cl. ..... 15/320; 15/322; 15/415.1

[58] Field of Search ..... 15/320, 322, 415.1

[56] References Cited

U.S. PATENT DOCUMENTS

| | | | |
|---|---|---|---|
| 3,619,848 | 11/1971 | Salzmann | 15/320 |
| 4,107,816 | 8/1978 | Matthews | 15/320 |
| 4,182,001 | 1/1980 | Krause | 15/320 |
| 4,264,999 | 5/1981 | Monson . | |
| 4,339,840 | 7/1982 | Monson | 15/320 X |
| 4,441,229 | 4/1984 | Monson | 15/320 X |
| 4,692,959 | 9/1987 | Monson . | |
| 5,163,203 | 11/1992 | Tanasescu et al. | 15/320 |

FOREIGN PATENT DOCUMENTS

| | | | |
|---|---|---|---|
| 576560 | 5/1933 | Germany | 15/320 |

*Primary Examiner*—Chris K. Moore
*Attorney, Agent, or Firm*—Jensen & Puntigam

[57] ABSTRACT

A carpet cleaning head wherein the head 8 is fabricated of two mating elements, a shroud 12 and an inverted cup-shaped main body portion 14, wherein the main body portion incorporates radially extending vacuum scrubbers 30 and has secured thereto on the underside thereof nozzles 40 for supplying heated cleaning fluid under pressure. The cleaning head 8, including the shroud 12, rotates forming a moving seal with the carpet containing the heated pressurized cleaning fluid, exaggerating the pressure difference with the vacuum and enabling the scrubber to do a more complete cleaning operation.

4 Claims, 3 Drawing Sheets

CLEANING HEAD

TECHNICAL FIELD

This invention relates to a rotary head for carpet cleaning and, more particularly, to a unit which includes a downwardly open, cup-shaped main body member having axially downwardly open exterior grooves formed by axially projecting, radially oriented fin pairs for removing the dirt and fluid by vacuum, a plurality of axially located nozzles providing the cleaning solution, and a shroud member which is secured to the upper portion and overlying body member, closing the upper end of the vacuum grooves, resulting in a mechanically simple but functional power scrubbing head, wherein the vacuum elements extend beyond the shroud such that the shroud sits on the carpet, forming a semi-seal while the vacuum elements agitate the carpet itself.

BACKGROUND OF THE INVENTION

Mechanical apparatus for cleaning carpets and other flooring have been in existence for sometime, and in general the carpet cleaners operate with similar principles by injecting a cleaning fluid carried by hot water or steam into the carpet, agitating the carpet and extracting at least the majority of the now soiled liquid.

Particular references known to the inventor include U.S. Pat. No. 3,624,668 granted to Krause, Nov. 30, 1971, which discloses a rug cleaning and rinsing device wherein a plurality of rotating pick-up nozzles and one rotating spray nozzle are mounted within a stationary shroud. The shroud forms a plenum around the rotating portion through which the vacuum is drawn. The liquid is fed downwardly through the center of the rotating element.

U.S. Pat. No. 4,264,999 granted to Monson, May 5, 1981 discloses a mechanism wherein both the liquid application and vacuum withdrawal are on a rotating member covered by a stationary shroud.

U.S. Pat. No. 4,441,229 granted to Monson, Apr. 10, 1984 discloses a device wherein the vacuum and fluid are fed through the center of the rotating cleaning head and the vacuum elements are mounted on flexible members which in turn support the entire cleaning device.

U.S. Pat. No. 4,692,959 granted to Monson, Sep. 15, 1987 discloses a carpet cleaning device wherein cleaning liquid and vacuum are both fed through the center of the rotating hub and the individual vacuum heads rotate about their axis while simultaneously rotating about the main hub axis.

BACKGROUND OF THE INVENTION

It is one object of the present invention to provide a carpet cleaning mechanism wherein the scrubbing head and its overlying shroud both rotate and wherein the relative axial position of the bottom of the shroud and the scrubbing heads is such that the scrubbing nozzles sink downwardly somewhat in the carpet, leaving the shroud to form a partial seal with the carpet, concentrating the spraying, scrubbing and vacuuming to the space beneath the shroud.

Another object of the present invention is to provide an area of improved cleaning, since the shroud rotates it provides a moving seal entrapping the cleaning fluid, concentrating the heat and pressure. In contrast, the scrubbing vacuum nozzles agitate the carpet and are more effective in removing the soiled material because of the greater pressure differential created.

Another object of the present invention is to provide a scrubbing head which is simple of construction, easy to manufacture, and thus inexpensive, while doing a superior job of cleaning.

Still another object of the present invention is to have a cleaning head which can be used on a number of machines but which includes means to prevent damage to the device by allowing it to be automatically guided over protruding stationary objects such as heat registers or the like.

BEST MODE FOR CARRYING OUT THE INVENTION

Figure 1:
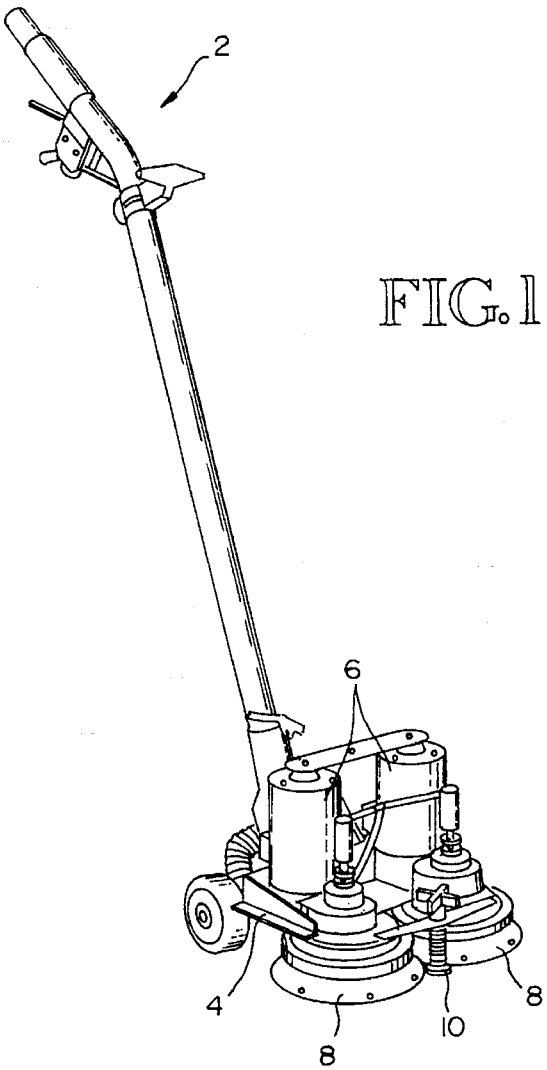
FIG. 1 is an isometric view of a dual headed machine utilizing the inventive cleaner head.

As seen in FIG. 1, the carpet cleaning device illustrated includes a handle with controls which also serves as a conduit for the vacuum removal and cleaning fluid. At the lower end of detachable handle 2 is a frame element 4 supporting a pair of electric motors 6 which drive a pair of cleaning heads 8, to be described in greater detail hereinafter. The height guide to control the carpet penetration is shown at 10.

Figure 2:
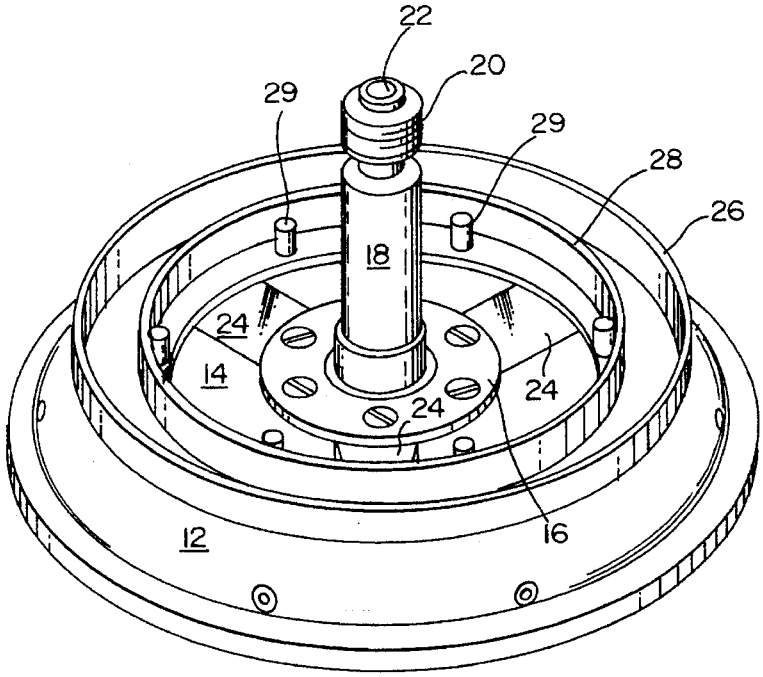
FIG. 2 is an enlarged isometric view of the cleaning head itself.

Reference is now had to FIG. 2, wherein the shroud 12 is shown encapsulating the main body portion 14, which has secured thereto a hub 16, including a central upwardly extending hollow drive shaft 18, which includes at its upper end a threaded element 20 for securement to a driving mechanism as well as a vertical opening 22 to receive the cleaning fluid. Also seen in this view are the vacuum openings 24 for extracting the soiled liquid. At the upper surface of the shroud 12 are concentric rings 26, 28, ring 26 to improve structural strength whereas the inner ring 28 is used in combination with pegs 29 to retain a seal interacting with a stationary cover.

Figure 3:
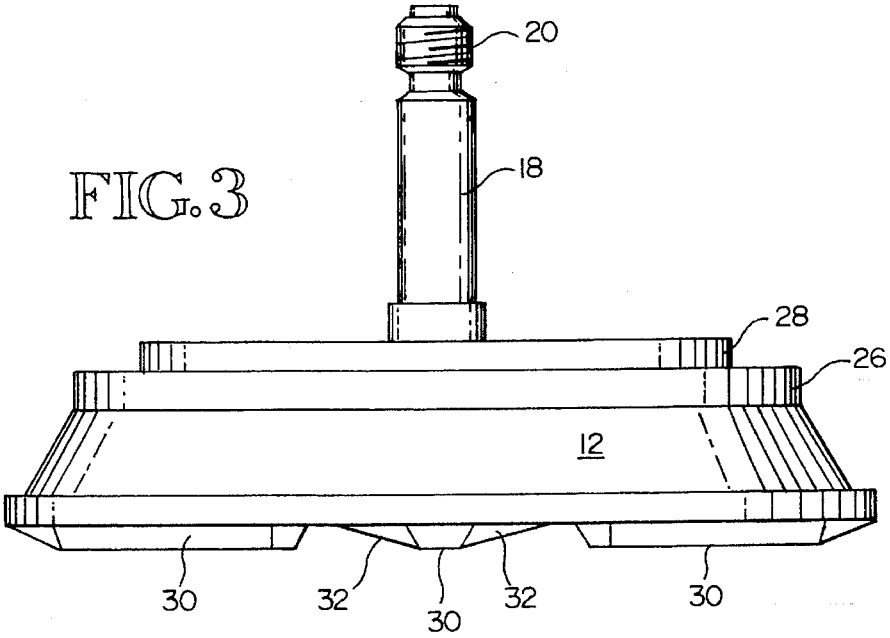
FIG. 3 is a vertical view of the cleaning head itself.

Reference is now had to FIG. 3, wherein similar numbers are used to designate similar parts. As seen in this view, the shroud is basically a downwardly open cup shape which encapsulates the main body 14 by overlying said body. The downwardly extending vacuum slots and scrubber nozzles 30 are seen in this view, as well as tapered portions of the main body portion 32, which allows the device to ride up over a rigid fixed object without damage to the machine.

Figure 4:
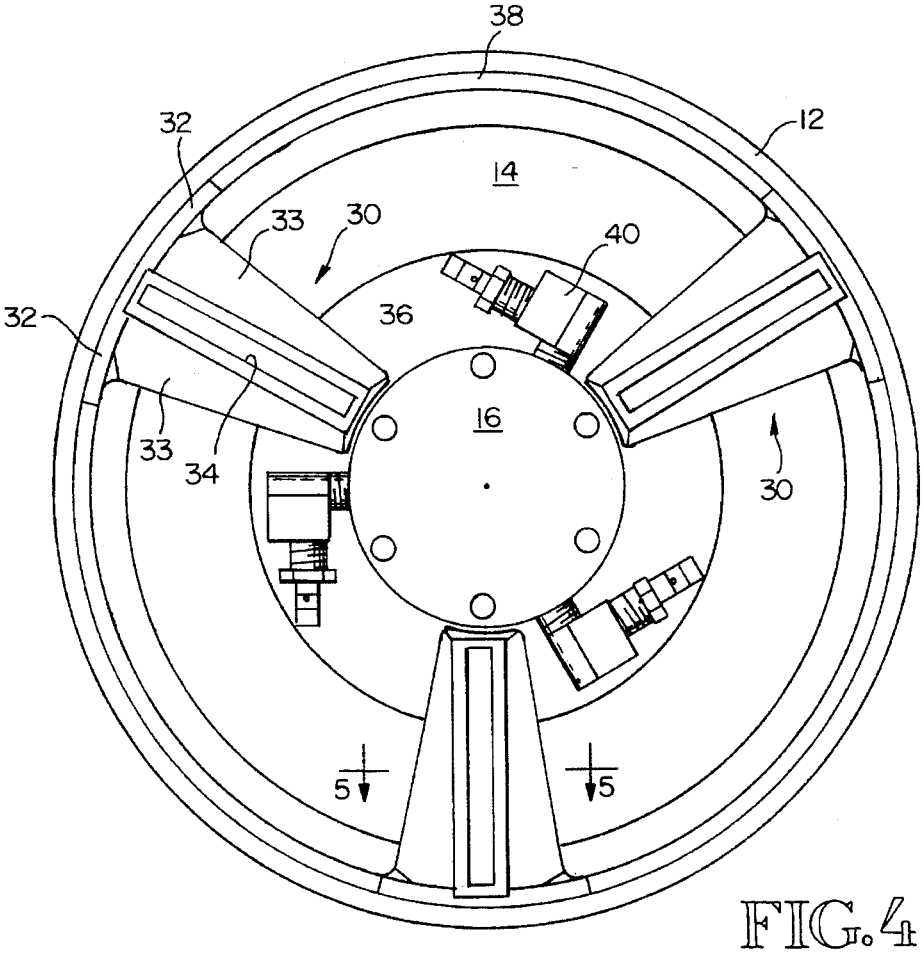
FIG. 4 is a bottom plan view of the cleaning head.

Referring now to FIG. 4, it can be seen that in the particular device there are three scrubber feet 30 which include a pair of radially extending, tapered side walls 32, terminating in a lower portion with a rectangular slot 34 defined by a lower lip surface generally rectangular in configuration 36. The main body portion 14 of the scrubber head is likewise in the configuration of an inverted cup, having the lower rim as seen at 38, which includes the tapered portion 32 to raise the device when a rigid solid object is encountered. The central hub 16, as seen in this bottom view, carries a plurality of spray nozzles 40 for the application of the cleaning fluid.

Figure 5:
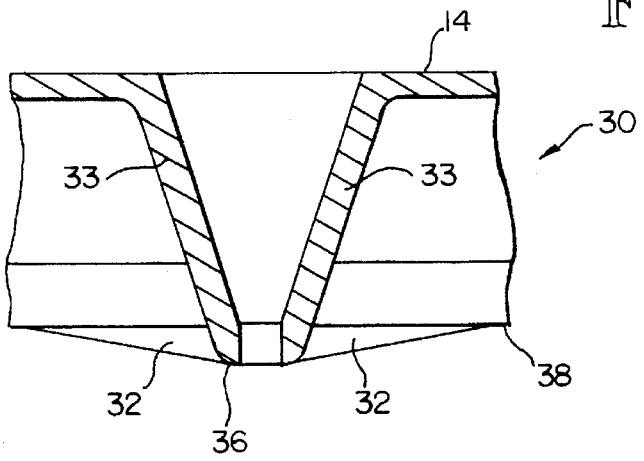
FIG. 5 is an enlarged view along lines 5—5 of FIG. 4.

Referring now to FIG. 5, the scrubbing foot, generally designated as 30, can be seen including the tapered walls 33, the lip profile 36, and the transition tapers 32.

Figure 6:
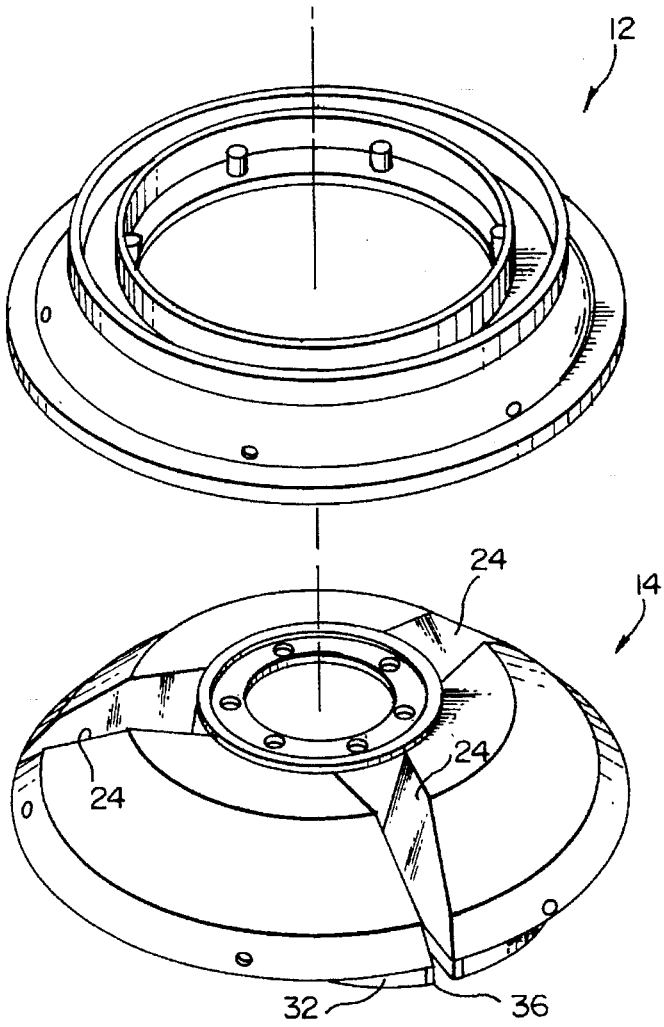
FIG. 6 is an exploded view of the head and shroud.

As perhaps best seen in FIG. 6, the main body portion 14 comprises an inverted cup-shaped structure having a plurality of axially extending grooves or openings 24 formed therein for removing the soiled fluid by vacuum which is drawn through the center of the shroud 12. Shroud 12 when assembled overlies the body portion 14, enclosing a portion of the grooves 24. Likewise seen in this view is the central opening for receiving the hub 16 and attached spray nozzles.

Thus, as can be readily determined, the present invention provides an inexpensive carpet scrubber which is easy to use and provides a superior cleaning function. The present device is fabricated of two pieces secured together to form a unit simple to fabricate, whereas the prior art devices contained many elements which were difficult to fabricate and assemble.

I claim:

1. A cleaning head for use in conjunction with a powered carpet cleaner, wherein cleaning fluid is supplied under pressure and a vacuum is provided to remove the fluid and extract the soil, said head comprising:

a downwardly open, cup-shaped main body member including a central bore along the center line of the main body member and a plurality of walls extending in a direction parallel to the center line into the main body member, said walls occurring in pairs and terminating in a plurality of slots extending radially outwardly from said center line, such slots located below the rim of the main body member, said space between the pairs of walls being open upwardly and radially outwardly from said slots; and shroud means having an inner surface substantially congruent to the exterior surface of the body members such that when in place it covers a substantial portion of the upper and outer openings between the walls.

2. A cleaning head as in claim 1, wherein the pairs of walls converge as they extend downwardly.

3. A cleaning head as in claim 1, wherein the rim of the main body potion therefor includes portions that are adjacent the slots which taper from the edge of the cup to the elevation of the slots.

4. A cleaning head for use in conjunction with a powered carpet cleaner wherein cleaning fluid is supplied under pressure and a vacuum is provided to extract the fluid and soil combination, the head comprising:

a hollow base unit generally in the shape of a hollow spherical segment having two bases, said base unit open downwardly toward the larger base of the segment and closed upwardly with the exception of a bore along the axis of symmetry and a plurality of vents, a plurality of walls occurring in pairs extending in a radial direction from said axis and downwardly to a plane below the larger base of the segment; and shroud means secured to the base unit covering the outside periphery of said base unit leaving open the vents and bore of the base unit permitting attachment of the head to a carpet cleaner and removal of the fluid.

* * * * *